US005195823A

United States Patent [19]

Sidabras

[11] Patent Number: 5,195,823

[45] Date of Patent: Mar. 23, 1993

[54] LAMP AND EXTENSION CORD SET

[75] Inventor: Romie K. Sidabras, Riverside, Calif.

[73] Assignee: Allied Wholesale, Inc., Sylmar, Calif.

[21] Appl. No.: 880,205

[22] Filed: May 6, 1992

[51] Int. Cl.[5] ..... F21L 15/22

[52] U.S. Cl. ..... 362/387; 362/269; 362/287; 362/376; 362/389; 362/427

[58] Field of Search ..... 362/327, 250, 269, 285, 362/287, 376, 389, 418, 419, 427

[56] References Cited

U.S. PATENT DOCUMENTS

| | | | |
|---|---|---|---|
| 1,644,923 | 10/1927 | Hitchcock | 362/376 |
| 3,592,157 | 7/1971 | Schwartz | 362/387 |
| 4,075,470 | 2/1978 | Moore | 362/387 |
| 4,506,317 | 3/1985 | Duddy | 362/419 |
| 4,535,391 | 8/1985 | Hsiao | 362/285 |
| 4,644,456 | 2/1987 | Lydell | 362/376 |
| 5,003,450 | 3/1991 | Burton et al. | 362/387 |

FOREIGN PATENT DOCUMENTS

| | | | |
|---|---|---|---|
| 2406358 | 5/1976 | Fed. Rep. of Germany | 362/387 |

*Primary Examiner*—Ira S. Lazarus
*Assistant Examiner*—L. Heyman
*Attorney, Agent, or Firm*—Lyon & Lyon

[57] ABSTRACT

A lamp and extension cord set comprising a removable extension cord reel and lamp set mounted onto a stable base frame platform and provided with at least two handlebars for carrying. The extension cord reel connects a lamp to a distant power supply and is provided with a curved stop bar as a safety feature and a handlebar for carrying the barrel. The lamp set contains the light source within a lamp head and a lamp cover. A power switch and a separate retractile power cord are attached to the lamp set for connection to a power supply with or without the extension cord reel. The lamp may be pivoted or rotated both horizontally and vertically with respect to the base frame to adjust the direction of the light from the lamp. The lamp assembly may also be removed from the base frame to provide an overhead light source if desired.

4 Claims, 5 Drawing Sheets

LAMP AND EXTENSION CORD SET

The present invention relates to portable lighting equipment. The need for portable lighting which can be easily transported to inaccessible locations has plagued mankind for years. Portable light sources are needed for home and business remodeling tasks, automotive repair and maintenance work and a host of other jobs. Past attempts at portable lighting sources have had numerous drawbacks. If a lighting source was portable could be moved, the light usually did not provide sufficient illumination. These movable light sources were far too fragile and easily broken if kicked or dropped. Larger power sources meant that the light was too heavy to be carried by a single individual. In addition, the user usually was required to purchase a separate power cord. These light sources were also subject to shock hazards as they were not meant to be used near spilled water or other liquids. Also, the larger light sources were not easily fixed. With these units, should one component break, the user generally could not replace just the one broken part but had to replace the entire unit.

The present invention relates to a lamp and extension cord reel set removably connected in combination to a sturdy base frame. The base frame provides a stable, yet lightweight platform for the lamp and the extension cord reel. The present invention has numerous features. For example, one feature utilizes and adjustable screws are used to fasten both the extension cord reel and the lamp to the base frame. The base frame may be made of tubular shaped elements and may use anti-skid rubber cushions on the bottom portion to protect against slippage. The appearance of the base frame may match the outer appearance of the extension cord reel to produce a special sense of beauty. The lamp may contain a quartz-type of light source which is connected to the extension cord reel for convenient use over a wide working area. The direction of the light from the lamp can be conveniently adjusted both horizontally and vertically relative to the base frame. The lamp may also be detached from the base frame while connected to the extension cord reel should an overhead light source be needed.

The extension cord reel itself comprises an electrical extension cord which is wound around a rotatable barrel. The reel may utilize a multiple curved stop bar to keep the extension card tightly on the barrel and away from the heat of the lamp which could damage the extension cord. A separate handlebar is placed above the barrel to allow the user to conveniently hand carry the whole assembly. The extension cord reel uses two fastening elements placed on its outer edges at two opposite locations for securing the extension cord at any desired length. A prominent space is provided on the barrel for labeling or marking while a removable driving handle is attached to the extension cord reel for manually taking up the extension cord. The extension cord may be made in conformity with 50 ft. UL specification, of which the plug and other prominent parts are made in a yellow color for warning.

The light source of the lamp is placed inside a lamp head. A guard consisting of a plurality of U-shaped rods is mounted on a cover placed over the light source to protect a user's hands from the generated heat and protect the light source itself from breakage. A handle on the lamp may be covered with a layer of PVC covering for comfort and positive grip. To further enhance the utility of this invention, a feature of the invention separate retractile power cord and switch are provided on the lamp for connecting the lamp to a power supply directly or via the extension cord reel. Accordingly, it is an object of the present invention to provide a lamp and extension cord set. Other and further objects and advantages will appear hereinafter.

DETAILED DESCRIPTION OF THE PREFERRED EMBODIMENT

Figure 1:
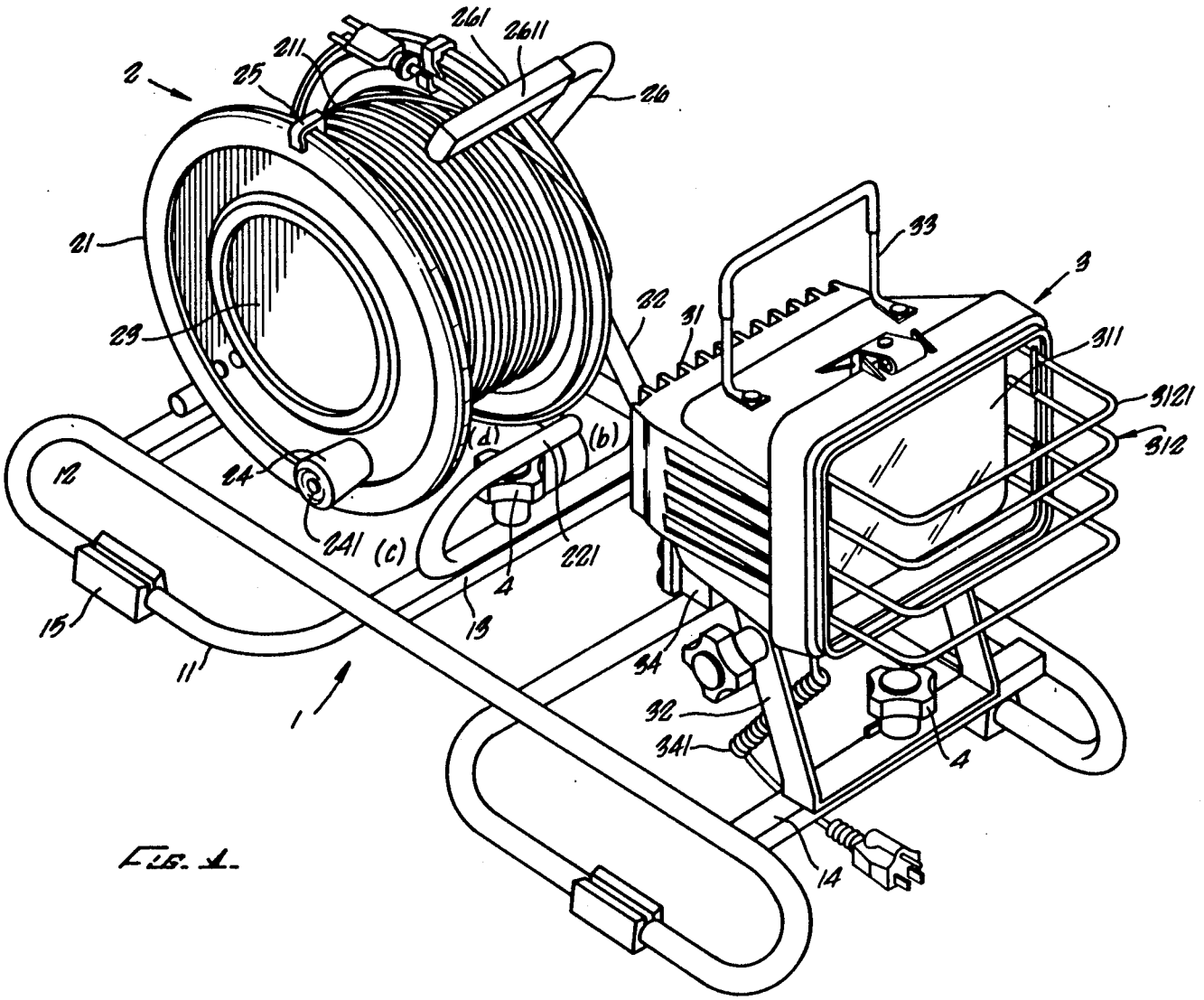
FIG. 1 is a perspective view of the preferred embodiment of the lamp and extension cord set of the present invention.

Referring to the figures, the present invention is first shown in FIG. 1 comprised of a base frame 1 having mounted thereon an extension cord reel 2 and a lamp set 3 respectively secured in place by adjusting screws 4 which are designed to be manually tightened and untightened.

Figure 2:
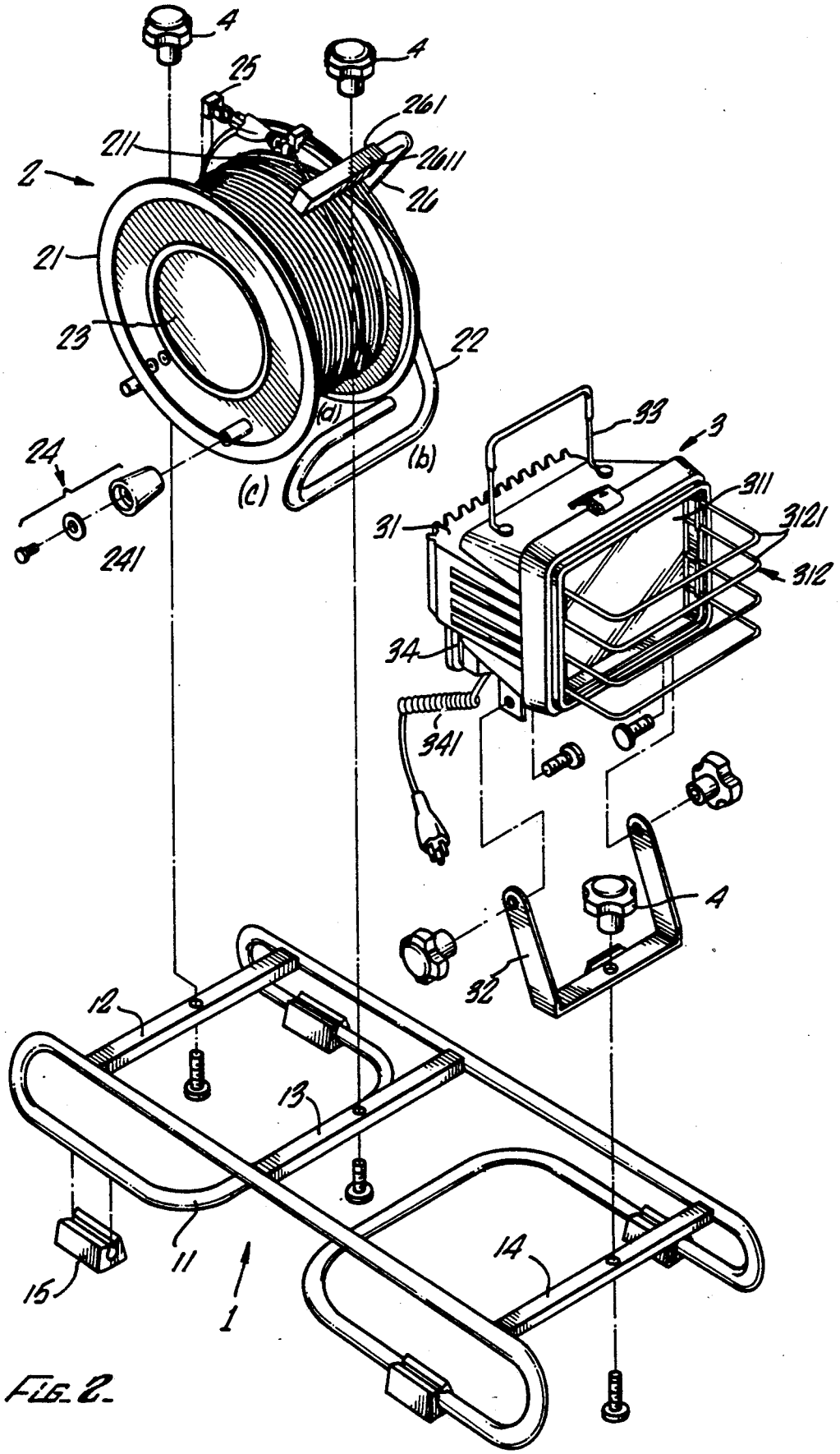
FIG. 2 is a dismantled perspective view thereof.

In the preferred embodiment, the base frame 1 is made from tubular elements 11 which are bent into a shape having a narrower upper part disposed above a wider lower part as shown in FIGS. 1 and 2. The base frame 1 can be firmly placed on a flat surface to support the extension cord reel 2 and the lamp 3 while the base frame 1 acts as a platform for both items. A plurality of anti-skid rubber cushions 15 are attached at the wider lower part of the base frame 1 at approximately the four corners. A plurality of cross bars 12, 13 and 14 are fastened to the narrower upper part of base frame 1. The first and second cross bars 12 and 13 are provided for fastening the extension cord reel 2 and the third cross bar 14 is provided for fastening the lamp 3 as shown in FIG. 2.

As shown in FIG. 2, the extension cord reel 2 comprises a barrel 21 revolvably fastened on a winding shaft 212. The shaft 212 is separately shown in a side view in FIG. 3. An electrical extension cord 211 is wound on the barrel 21 in a conventional fashion. A curved stop bar 22 crosses over said extension cord 211 as shown in FIGS. 1 and 2.

Figure 3:
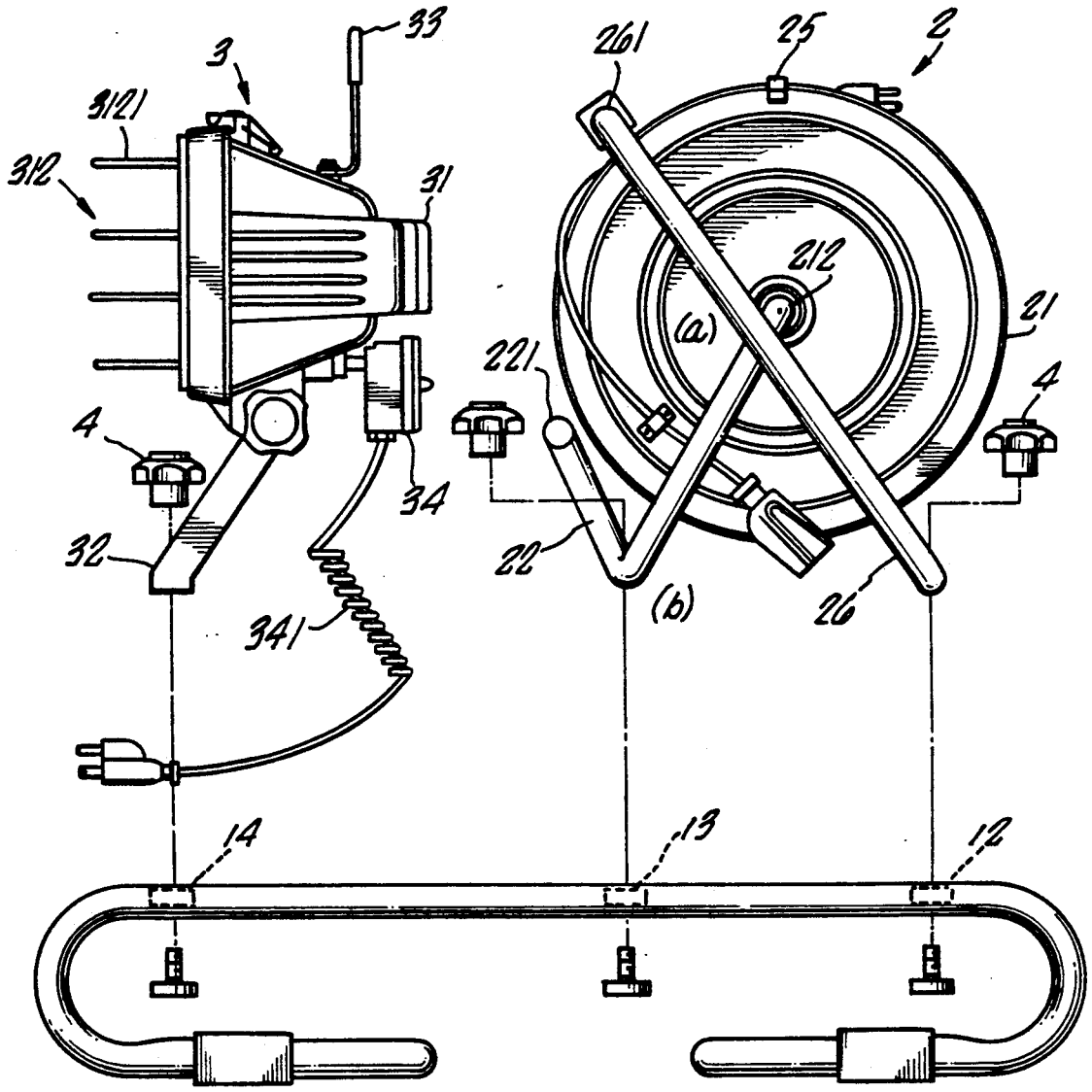
FIG. 3 illustrates that the lamp and the extension cord reel can be respectively detached from the base frame for use separately.

A U-shaped handlebar 26 crosses over a portion of the extension cord 211 and barrel 21. This handlebar 26 is in a position to be gripped by the user's hand for lifting and moving the extension cord reel 2. An opposite end 261 is covered with a protective covering 2611, as shown in FIG. 2, for a comfortable and positive grip. The curved stop bar 22, as shown in FIGS. 2 and 3, is comprised of four bends a, b, c and d integrally connected in series. The first bend a is provided for fastening to the U-shaped handlebar 26. The second bend b provides a surface to secure to the second cross bar 13 by an adjusting screw 4. The fourth bend d is disposed above the barrel 21 a short distance away to keep the extension cord 211 away from the lamp 3. A blank surface 23 is provided on one side of the barrel 21 for labeling or marking.

A driving handle 24 is fastened to said barrel 21 at one side for causing the barrel 21 to rotate on the winding shaft 212 and to wind or "take up" the extension cord 211. The driving handle 24 is fastened to the barrel 21 at the side opposite to the curved stop bar 22 and the handlebar 26. It has a hollow crank shaft 241 which can be pulled out when the driving handle 24 is not in use. The driving handle 24 is again designed to fit in the user's hand to allow the user to manually cause the barrel 21 to rotate on the winding shaft 212 to take up the extension cord 211. As shown in FIGS. 1 and 2, two fastening elements 25, each having a sideways "S" shape, have one end fastened on the edge of the barrel 21 and an opposite end disposed above the cord 211 for attaching to a portion of the extension cord 211 at a desired length.

Figure 4:
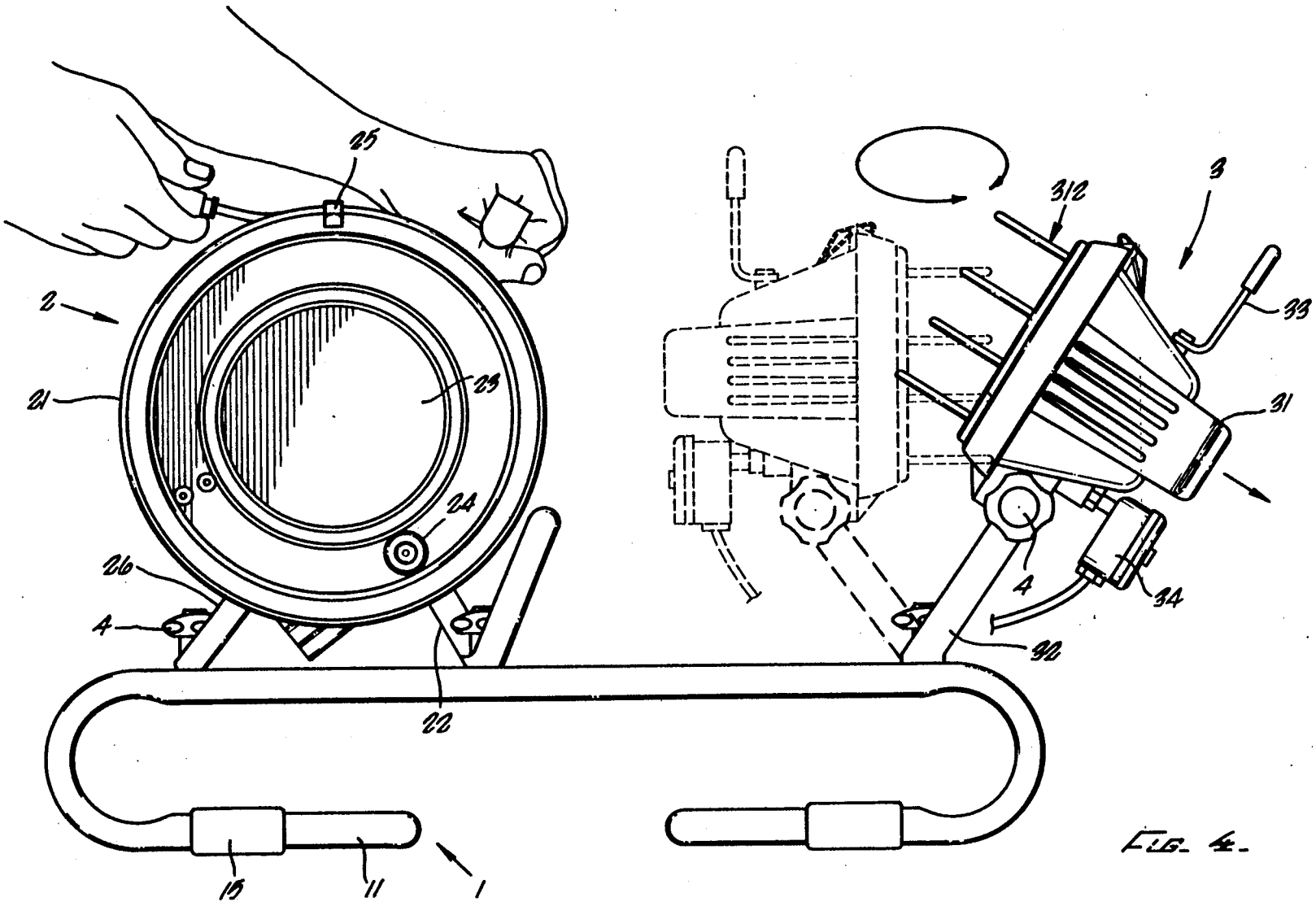
FIG. 4 illustrates that the lamp can be rotated to a desired angle and direction.
Figure 5:
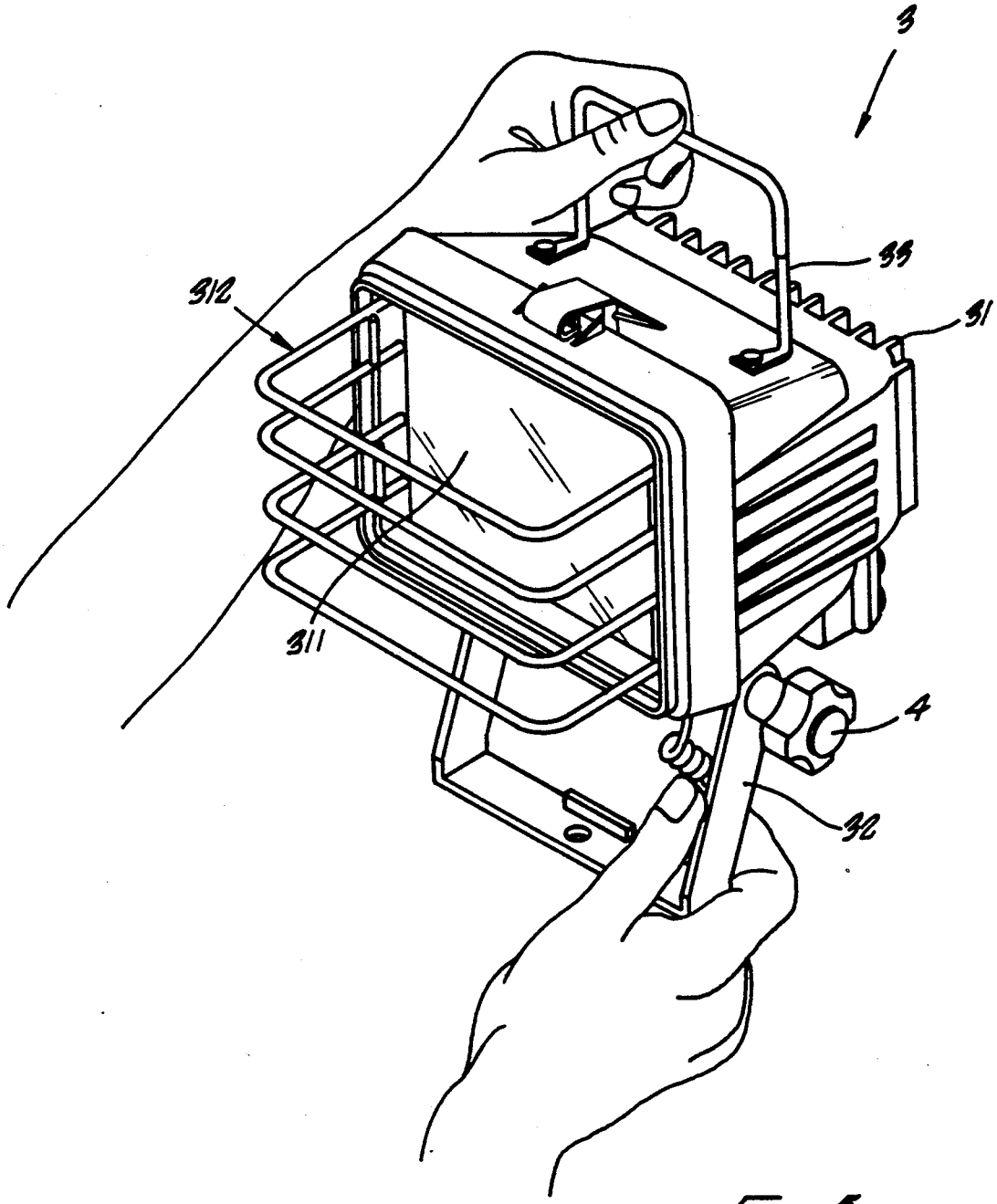
FIG. 5 illustrates that the lamp has been detached from the base frame.

The lamp set 3 comprises a light source within a lamp head 31 pivotably secured to a U-shaped bracket 32 by two adjusting screws 4 as shown in FIGS. 2 and 3. The light source may be of a quartz type of light. The U-shaped bracket 32 has a bevel bottom edge at the middle secured to the third cross bar 14 by an adjusting screw 14. FIG. 4 exemplifies some of the movements of the lamp 3. A U-shaped handle 33 is placed at the top of the lamp cover 31 for carrying by hand. A power switch 34 is also provided on the lamp head 31 along with a retractile power cord 341 that extends from the power switch 34 for connecting to a power supply directly or through the extension cord reel 2. A lamp cover 311 is placed on the lamp set 3 at the front. U-shaped guards 312 project from the lamp cover 311 for protection as shown in FIG. 2 and are formed of a plurality of U-shaped rods 3121 spaced from and disposed in a parallel relationship with one another. FIG. 5 illustrates that the lamp set 3 may be removed from the base 1. In addition, the U-shaped handle 33 is covered with a layer of flexible PVC (polyvinyl chloride) covering for a comfortable and positive grip. With the protective covering 2611 on the opposite end 261 of the U-shaped handlebar 26 along with the U-shaped handle 33, the extension cord reel 2, the lamp 3 and the base frame 1 can be carried by one person.

While specific embodiments of the invention herein claimed have been described and shown, it will be apparent to those skilled in the art that many modifications on these embodiments are possible without departing from the inventive concepts herein claimed. Accordingly, this patent and the protection provided hereby is not limited to the specific embodiments set forth above but is of the full breadth and scope of the appended claims.

What is claimed is:

1. A lamp and extension cord set, comprising:

a base frame comprising tubular elements bent into a shape having a narrower upper part disposed above a wider lower part, a first cross bar, a second cross bar and a third cross bar, each transversely fastened to said narrower upper part said base frame further comprising a plurality of anti-skid cushions on said wider lower part;

an extension cord reel, comprising a barrel mounted on a winding shaft with an extension cord removably wound on said barrel, a curved stop bar comprised of a plurality of bends integrally connected to said base frame and disposed above said extension cord reel, a U-shaped handlebar fixedly secured to said curved stop bar, one end of said handlebar longitudinally disposed above and secured to said first cross bar said handlebar further comprised of a protective covering for carrying by hand, a driving handle fastened to said barrel opposite to said curved stop bar for causing said barrel to rotate on said winding shaft said driving handle comprising a hollow crank shaft, said extension cord reel further comprising fastening elements removably fastened on said barrel for releasably securing said extension cord; and a lamp set, comprising a light source secured within a lamp head pivotally secured to a U-shaped bracket, said U-shaped bracket attached to one of said cross bars, said lamp set further comprising a U-shaped handle, a power switch and a retractile power cord extending from the power switch for connecting to a power supply directly or through said extension cord reel, a lamp cover and a plurality of U-shaped rods disposed in parallel relationship with one another adjacent to said lamp cover.

2. A lamp and extension cord set comprising:

a base frame and a plurality of cross bars connected to said base frame;

an extension cord reel, demountably attached to said base frame at said cross bars and comprising a rotatable barrel having an extension cord removably wound thereon, a curved stop bar secured to said base frame and disposed adjacent to said barrel said stop bar comprising a multiplicity of curved surfaces so one end of said stop bar is disposed in close proximity to said wound extension cord, a handle bar fixedly secured to said stop bar, a driving handle fastened to said barrel for manual rotation of said barrel and fastening elements attached to said barrel to releasably secure a portion of said extension cord;

a lamp set, comprising a light source secured within a lamp head and lamp cover, said lamp set demountably attached to said base frame at one or more of said cross bars by a bracket to allow said lamp to pivotally move and rotate with respect to said base frame, a power switch connected to a retractile power cord, said lamp set further comprising a U-shaped handle secured to said lamp head and a lamp guard secured adjacent to said lamp cover.

3. A lamp and extension cord set comprising:

a base frame having means for securing a plurality of objects thereto;

an extension cord reel, removably secured to said base frame and comprising a rotatable barrel, a removable extension cord wound on said barrel, a curved stop bar disposed adjacent to said barrel, a U-shaped handlebar and a driving handle to rewind said extension cord; and a lamp set, comprising a light source within a lamp head assembly, said lamp head assembly attached to a U-shaped bracket and removably coupled to said base frame to allow said lamp set to rotate in a vertical plane and to rotate in a horizontal plane, a power switch and a retractile power cord attached to said power switch, a handlebar and a lamp guard placed over said light source.

4. The lamp and extension cord set of claim 2 or 3 wherein said base frame is of a unitary tubular element bent to have a wider lower part and a narrower upper part and comprising anti-skid means on said wider lower part.

* * * * *